US007169260B2

(12) United States Patent
Grön et al.

(10) Patent No.: US 7,169,260 B2
(45) Date of Patent: Jan. 30, 2007

(54) PRECALENDERING METHOD, FINISHING METHOD AND APPARATUS FOR IMPLEMENTING THE METHODS

(75) Inventors: Johan Grön, Espoo (FI); Kari Sipi, Espoo (FI)

(73) Assignee: Metso Paper, Inc., Helsinki (FI)

( * ) Notice: Subject to any disclaimer, the term of this patent is extended or adjusted under 35 U.S.C. 154(b) by 527 days.

(21) Appl. No.: 10/312,147

(22) PCT Filed: Jun. 20, 2001

(86) PCT No.: PCT/FI01/00594

§ 371 (c)(1),
(2), (4) Date: Jun. 30, 2003

(87) PCT Pub. No.: WO02/00998

PCT Pub. Date: Jan. 3, 2002

(65) Prior Publication Data

US 2004/0020618 A1 Feb. 5, 2004

(30) Foreign Application Priority Data

Jun. 20, 2000 (FI) ..... 20001456

(51) Int. Cl.

| | |
|---|---|
| ***D21H 19/76*** | (2006.01) |
| ***D21H 19/84*** | (2006.01) |
| ***B05C 1/08*** | (2006.01) |
| ***B05D 1/28*** | (2006.01) |

(52) U.S. Cl. ..... 162/135; 162/205; 162/206; 162/265; 162/361; 118/44; 118/60; 118/68; 118/72; 118/226; 118/227; 427/211; 427/317; 427/326

(58) Field of Classification Search ..... 162/135–137, 162/204–206, 361, 265; 118/60, 67, 68, 118/72, 117, 118, 122, 44, 226, 227; 427/324–326, 427/308, 317, 361, 209–211; 100/38, 153, 100/161, 162 R
See application file for complete search history.

(56) References Cited

U.S. PATENT DOCUMENTS 3,288,632 A 11/1966 Rush et al.

(Continued)

FOREIGN PATENT DOCUMENTS

DE 198 24 804 12/1999

(Continued)

OTHER PUBLICATIONS

International Search Report issued in International Patent Application No. PCT/FI01/00594.

(Continued)

*Primary Examiner*—Eric Hug
(74) *Attorney, Agent, or Firm*—Stiennon & Stiennon

(57) ABSTRACT

A paper or paperboard web (W) is precalendered. A web that has undergone earlier dewatering stages is calendered to attain a suitable surface for the coating process. The web is calendered (C) one-sidedly in such a manner that the absorption level of the second side (W2) of the web entering the calendering, which is higher than the absorption level of the first side (W1), is reduced in the calendering nearly to the same level or at least to the same level with the first side (W1).

14 Claims, 2 Drawing Sheets

U.S. PATENT DOCUMENTS

| | | | | |
|---|---|---|---|---|
| 3,767,451 | A * | 10/1973 | Busch | 427/150 |
| 4,606,264 | A | 8/1986 | Agronin et al. | |
| 5,163,364 | A * | 11/1992 | Bubik et al. | 100/38 |
| 5,378,497 | A * | 1/1995 | Johnson et al. | 427/211 |
| 5,505,820 | A * | 4/1996 | Donigian et al. | 162/206 |
| 5,641,387 | A | 6/1997 | Baldini | |
| 6,287,424 | B1 * | 9/2001 | Mohan et al. | 162/206 |
| 6,485,611 | B2 * | 11/2002 | Bauer | 162/205 |

FOREIGN PATENT DOCUMENTS

| | | |
|---|---|---|
| EP | 0 608 206 | 7/1994 |
| WO | WO 97/29239 | 8/1997 |
| WO | WO 99/67462 | 12/1999 |
| WO | WO 02/00998 | 1/2002 |

OTHER PUBLICATIONS

International Preliminary Examination Report issued in International Patent Application No. PCT/FI01/00594.

* cited by examiner

PRECALENDERING METHOD, FINISHING METHOD AND APPARATUS FOR IMPLEMENTING THE METHODS

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a precalendering method, in which a paper or paperboard web that has undergone earlier dewatering stages is calendered to attain a suitable surface for the coating process. The invention also relates to a finishing method for paper or paperboard. Furthermore, the invention also relates to an apparatus for implementing the methods.

In the papermaking process the dewatering stages include the initial dewatering that has taken place in the wire section for formation of a web, dewatering of the formed web by pressing in the press section and drying by means of heat in the drying section, in which the moisture of the web is reduced to a suitable level for further processing.

After the paper has been dried, desired surface structure of the web is attained by means of a mechanical treatment applied to the surface, i.e. calendering. There are many calendering methods, but it is characteristic to all of them that the web is brought through one or more nips, which is/are formed between two surfaces, typically between rotating roll surfaces. The purpose of calendering is to improve the paper quality by pressing the paper into a particular standard thickness and especially by smoothening its surface. In view of the coating to be applied to the paper at the next stage, the purpose of calendering is to bind loose particles on the surface and close the surface so that the coating layer would become even.

It is well known that by means of calendering it is possible to attain a desired quality, such as smoothness and gloss for the paper produced and processed at earlier stages. At the same time a fixed final density is attained for the paper. Thus, the calendering affects both the visual and structural properties of paper. In the technique according to the present application, calendering is conducted as a preliminary treatment especially with that purpose in mind that the desired properties are attained on the surface of the paper for the coating of the paper to be conducted at the next stage, and thus the visual properties of the base paper, such as gloss, are not significant.

Due to different machine concepts, one-sidedness occurs in the web going through the above-described dewatering stages, which can be caused for example by one-sidedness of dewatering and the different properties of surfaces located against the paper web. It is for example possible that one side is more closed and possibly rougher, and the other side is more open and possibly smoother. One-sidedness causes problems when paper is coated on both sides, and thus the aim is to make the paper surface suitable for the spreading of the coating composition by means of so-called precalendering before the coating operation.

The purpose of precalendering before the coating process is to improve especially the smoothness of the rougher side. By means of precalendering it is possible to eliminate one-sidedness in smoothness, but one-sidedness in absorption increases further, because after the treatment of more closed and rougher surface the surface becomes even more closed. In a film transfer coating process conducted by means of two rotating application rolls, in which the web precalendered in this way is coated on both sides, it is important to control the detachment of the web after a coating nip formed between the rolls. The aim is that the web would be detached from the lower roll last, because in this way it is possible to avoid runnability problems. Because many machine concepts cause such an effect that the upper side, which typically is placed against the upper application roll in the coating nip as well, remains in a more closed state, and the one-sidedness in absorption resulting therefrom cannot be corrected by means of precalendering even though the smoothness would be brought on the same level, the more open lower surface absorbs too much coating colour, whereas on the upper side more coating colour remains on the surface. Thus, due to the larger amount of coating colour, the upper side tends to follow the upper roll after the nip, and it is last released therefrom, which causes runnability problems.

One runnability problem that possibly occurs is formation of mist and this is solved by arranging auxiliary devices on the outlet side of the coating nip, as is disclosed in the Finnish patent 101092 and in the corresponding international publication WO 97/29239. In cases where mist formation takes place, the problems typically occur on that side from which the web is released last. If the web is last released from the lower roll, the fuming can be restricted to the lower side where it causes fewer problems.

Furthermore, as for the basic principle of a film transfer coater, reference is made to publication EP 608 206 A1.

In theory, the problem can be solved by using clearly unequal amounts of coating composition on different sides. Then, however, another problem occurs: the quality becomes one-sided, which is not a good aspect in printing papers.

SUMMARY OF THE INVENTION

The purpose of the invention is to present a solution for the above-mentioned drawbacks and to introduce a precalendering method by means of which it is possible to improve the runnability of the web in the film transfer coating process following thereafter without impairing the quality.

After pressing and drying, the paper or paperboard web is calendered one-sidedly in such a manner that the absorption level of the second side, which is higher than the level of the first side before said calendering, is reduced nearly or at least to the same level with the first side. Thus, in the precalendering the web is run through the calendering nip, in which the different sides are subjected to a different treatment. The absorption level of the outer surface of the second side can be reduced by bringing it in contact with a hot surface in the nip for a sufficiently long period of time. Preferably this is implemented by means of a suitable so-called long-nip structure, which has extension in the travel direction of the web, wherein the residence time in the nip is the length of the nip divided with the web speed. The temperature is selected in such a manner that the aforementioned target comes true. The inlet moisture of the web to the calendering can be used as one variable.

The first side is only under calendering pressure in the nip without heat being exerted thereon to a significant degree. It is, however, possible that the surface in the nip that is placed against the first side is also by means of active heating measures brought to a temperature higher than the ambient temperature, but the surface placed against the second side has to be in a clearly higher temperature with respect thereto, so that the absorption level can be affected one-sidedly in the calendering. Thus, the absorption level of the second side is advantageously reduced at least to such a degree that the absorption level of the second side of the web departing from the calender is nearly as low or at least equally low as the absorption level of the outer surface of the first side. Especially if the one-sidedness in absorption has been very large before calendering, it is sufficient that the absorption level of the second side is reduced almost to the same level compared with the level of the other side, down to a difference of less than 1.0 g/m$^2$ therefrom when expressed as Cobb-Unger oil absorption.

Advantageously, the calendering is conducted one-sidedly in such a manner that the absorption level of the outer surface of the second side is lower than the absorption level of the outer surface of the first side in the web departing from the calender.

It is easier to run the web precalendered in the above-mentioned manner through a film transfer coating unit which is formed of two application rolls located on top of each other diagonally, for example in an angle of approximately 40 to 60°, or directly on top of each other (vertical angle). The rolls may also be positioned horizontally with respect to each other. In such a unit the web is run through the nip between the application rolls. If the second side whose absorption level is reduced nearly as low or at least equally low as the absorption level of the first side, is the lower side of the web passed to the nip between the rolls, the web is more reliably released last from the lower roll after the coating nip.

BRIEF DESCRIPTION OF THE DRAWINGS

In the following, the invention will be described in more detail with reference to the appended drawings, in which.

DESCRIPTION OF THE PREFERRED EMBODIMENTS

Figure 1:
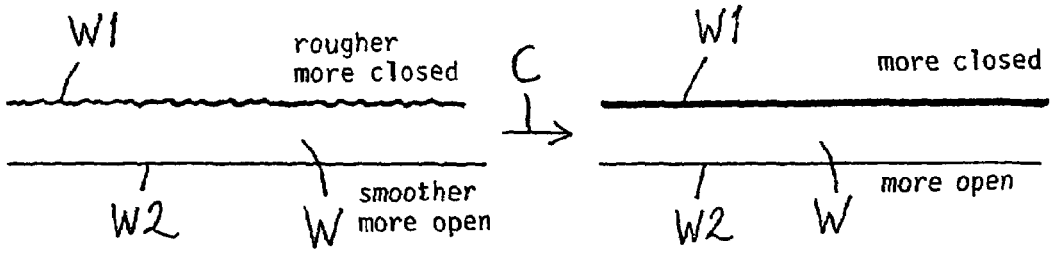
Fig. 1 PRIOR ART
FIG. 1 shows a precalendering process according to the state of the art.
Figure 2:
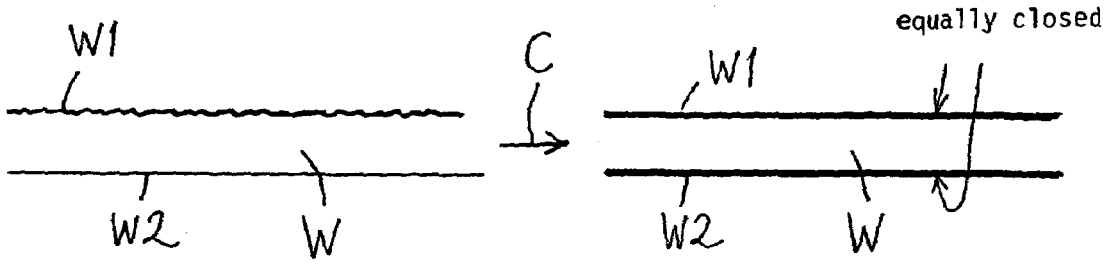
FIG. 2 shows a precalendering process according to the invention.
Figure 3:
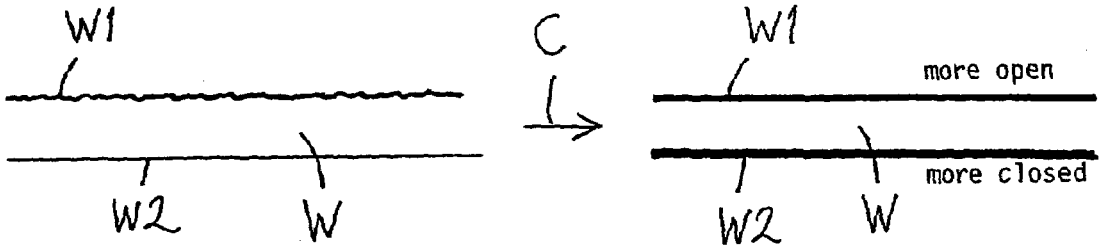
FIG. 3 illustrates a second precalendering process according to the invention.

FIG. 1 illustrates how a paper web has been treated in solutions according to the state of the art. FIG. 1, as well as FIGS. 2 and 3 are only intended to illustrate the state of the art and the invention, and the purpose of the same is not to describe the structure of paper in detail, but some features are exaggerated for the sake of clarity. In FIG. 1, due to the earlier dewatering stages, one-sidedness occurs in the paper web W both in roughness and absorption. The absorption level is illustrated by the thickness of the lines, wherein the thicker the line, the more closed the surface and the lower the absorption level. The roughness or "coarseness", in turn, is illustrated by the irregularity of the outline of the surface. In FIG. 1, the first surface W1 of the paper web W (the upper surface in the drawing) is rougher than the second surface W2 (the lower surface in the drawing), whereas the absorption level of the second surface W2 is higher than that of the first surface W1, i.e. the surface is "more open" (marked with a thinner line). When such a web is run through the calendering process C, the result is a web W shown schematically on the right-hand side, in which web W the roughness of the first surface is reduced, but the absorption level of the same is at the same time reduced even further, i.e. the surface has become more closed. This results in clear one-sidedness in absorption, in which the second surface W2 on the opposite side is clearly better capable of receiving water and aqueous mixtures, such as coating colour, than the first surface W1.

FIG. 2 shows the changes in the calendering attained by means of the method according to the invention. The roughness of the first side W1 is reduced and the absorption level is decreased in the precalendering process C in the above-described manner, but at the same time the absorption level of the second side is affected in such a manner that it is reduced nearly or at least to the same level with the absorption level that the first side W1 has when exiting the calender. Thus, such one-sidedness in absorption is removed which in the above-described manner is harmful in the film transfer coating process following the calendering.

FIG. 3 shows a second alternative, in which the aim is to attain one-sidedness in absorption in the paper web W, but in such a manner that the absorption level of the second side W2 is lower than that of the first side W1 as a result of the precalendering process C.

If in FIGS. 2 and 3 the second side W2 whose absorption level is reduced is the lower side of the web passed to the film transfer coating, such reduction in the absorption level makes it possible to get the web to follow the lower roll after the coating nip in a more reliable manner.

Figure 4:
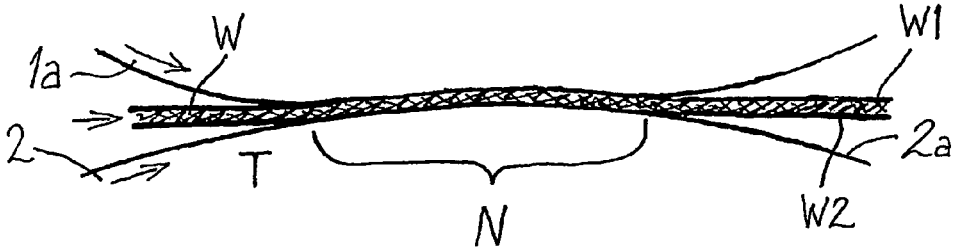
FIG. 4 shows the calendering nip used in the precalendering process.

FIG. 4 shows schematically the calender nip N of the precalendering process used in the invention. In this case the second side W2 whose absorption level is reduced is the lower side of the web, which in the film transfer coating succeeding the calendering is placed against the lower roll in the coating nip. The nip is a so-called long nip which is produced when a hard-faced roll 2 that is arranged rotatable and a soft, elastic continuous material 1*a* are loaded against each other, which material can be the soft roll coating of a second, rotating calender roll, a belt guided over a solid shoe element, or a belt guided over a rotating counter roll. Thus, the shape of the nip is formed as a result of the combined effect of loading and the elasticity of the material. The paper web W to be calendered is guided between the hard roll surface and the material 1*a*, wherein it travels in the nip N a fixed distance under pressure. The shell surface 2*a* of the roll 2 and the material a move substantially at the speed of the paper web W. The pressure prevailing in the nip is determined by the mutual loading of the hard-faced roll 2 and the counter element (roll body of a soft-faced roll, counter roll, or a shoe element) supporting/bearing the elastic material, which can also be indicated as linear load (loading force/width of the paper web). In a known manner the pressure varies in the longitudinal direction of the calender nip so that it is gradually increased to a maximum value, which is located approximately in the centre of the nip, and thereafter it is gradually reduced to the original pressure. By adjusting the shoe it is possible to change the pressure profile and nip length. The length of the nip can be for example at least 50 mm, advantageously at least 70 mm. The hard-faced roll 2 is a so-called thermo roll, which can be heated in a known manner. The upper surface W1 of the paper web W is positioned against the soft material 1*a*, whereas the lower surface W2 is positioned against the heated surface 2*a*. Advantageously, the surface temperature is arranged so high that the hot surface 2*a* in the contact under nip pressure during a predetermined residence time dependent on the nip length produces a plastic deformation of the fibres in the lower surface W2 of the paper web W. By means of the long nip and high moisture content it is possible to influence the temperature of the fibres so that the temperature is increased considerably above the glass transition temperatures of polymers contained in the fibres. For this purpose, the surface temperature T of the surface 2*a* of the roll 2 when said surface enters the calender nip is advantageously at least 200° C., more advantageously at least 250° C.

The residence time of the web in the nip N is the length of the nip divided with the speed of the paper web. During this time the lower surface W2 of the web is in a pressurized contact with the surface 2*a* of the roll at a fixed temperature, from which surface heat is transferred to the web. At present high machine speeds it is important to produce a sufficiently long nip, so that the web would be subjected to the effect of pressure and temperature for a sufficiently long time. By means of the geometry (shape and position) of the shoe element it is also possible to affect the pressure distribution in the long nip.

Figure 5:
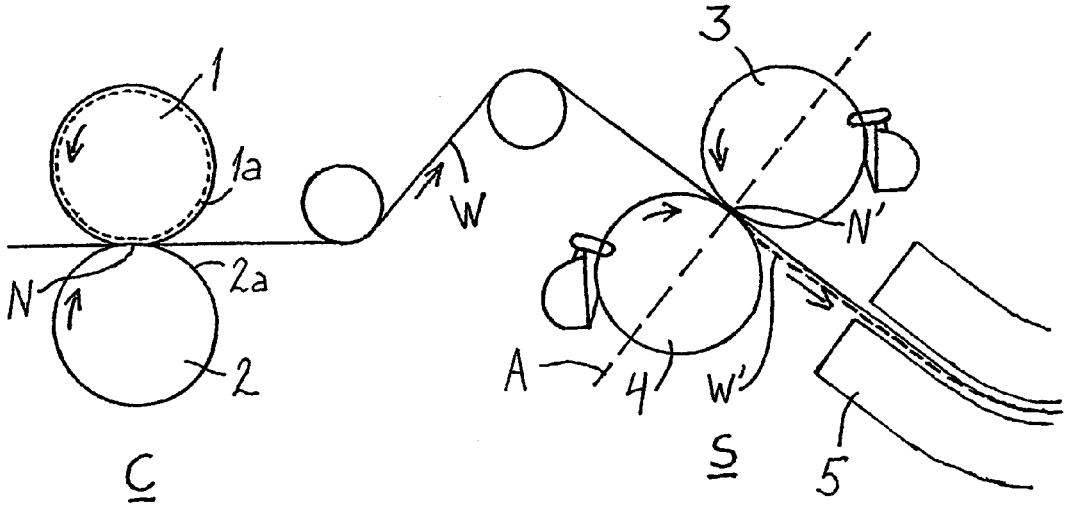
FIG. 5 shows a side-view of a processing line in which a paper web is calendered and coated by means of film transfer coating.

FIG. 5 shows a part of a papermaking line, in which a paper web W that has undergone the preceding dewatering stages is precalendered C before two-sided coating in film transfer coating S. Paper is passed as a continuous web to the calendering from the drying section in which it is dried to the suitable dry matter content. The paper is calendered in the extended nip N between the hard roll 2 and the soft-faced calendering element 1. In the figure, the soft-faced calendering element 1 is a rotating calender roll equipped with a soft roll coating, but it can also be formed of a belt in the form of a roll shell, which is loaded from inside by means of a shoe element, wherein the calender is a so-called shoe calender, or it may be a combination of a rotating counter roll and a continuous belt travelling over the same and through the nip.

When the web W has travelled through the calender nip N, the lower surface W2 of said web has reached a state in which it is permanently plasticized. Thereafter the web W is guided to the film transfer coating process S, in which coating colour is spread on both its surfaces W1, W2. The aqueous coating agent composition is spread by spreading a thin layer of coating agent evenly on the surface of both application rolls 3, 4 by means of a suitable application device, such as a blade, rod or jet application device and by transferring the coating in the coating nip N= on the surfaces of the web W1, W2. The portioned amount of coating is substantially the same for both sides. Thereafter the paper is dried in a known manner, possibly calendered, and finally reeled in the reel-up. The figure shows the beginning of a drying section 5, in which the web is guided along a curved path by means of air blowing boxes. In addition to or instead of them it is possible to use other drying solutions.

In the coating unit shown in the figure, the travel path of the web W is guided diagonally downwards, preferably in such a manner that it travels directly through the nip N=, i.e. the travel path is at right angles to the plane A between the central axes of the application rolls 3, 4, which is, in a known manner, in an angle of approximately 40 to 60 with respect to the vertical plane. The invention is not, however, restricted only to particular path geometries, and balancing of one-sidedness in absorption is advantageous in all coating units formed by application rolls. The web W follows the lower roll 4 a short distance after the nip N= and is released therefrom travelling along a path marked with a broken line W= to the turning point of the path located within the drying section 5, deviating slightly from the direct path.

As was mentioned above, it is often sufficient that the absorption level of the more open side is reduced at least to the same level as the more closed side has, or close to it, the more closed side meaning the more closed side before the calendering. Thus, by means of minor auxiliary means, it is possible to influence the web so that it is last released from the lower roll of the coating unit and it does not start to follow the upper roll.

The following tests illustrate the possibilities to calender the web one-sidedly in such a manner that the absorption level of the originally more open surface is reduced at least to the same value with the originally more closed surface. Although in the tests the lower surface of the web (which, when the web remains in the same position also forms the side positioned against the lower roll in film transfer coating) has already originally been more closed than the upper side, the effects of the one-sided calendering, both when conventional soft calendering and long-nip calendering are used, are shown in such a manner that the oil absorption of one side, correlating with the absorption level, is more clearly reduced on this side. Thus, it can be concluded that the originally more open side (with higher oil absorption) can be made more closed than the opposite side by arranging it against a hot surface in the calender nip and by selecting the conditions so that the one-sidedness in absorption is definitely eliminated or reversed.

Base paper with a basis weight of 40 g/m$^2$, in which 35% of the fibres consisted of chemical pulp and 65% of mechanical pulp and whose filler content was 5%, was subjected to precalendering tests by means of a soft calender with a hard roll and a soft-faced polymer roll as rolls forming a relatively short nip, and to other precalendering tests in a nip of 70 to 100 mm in length in a so-called shoe calender. The web speed was 1,000 m/min. The results are presented in the following table.

TABLE

Results of precalendering for 40 g/m$^2$ base paper in soft calendering and ling-nip calendering.

| | Uncalendering | Precalendering (soft/hard) | | | |
|---|---|---|---|---|---|
| Nip pressure (kN/m) | base | 60 | 60 | 150 | 150 |
| Surface temperature of the thermo roll (0°) | | 50 | 100 | 50 | 100 |
| Density (kg/m$^3$) | 585 | 685 | 691 | 721 | 731 |
| Moisture content (%) | 4.2 | 4.1 | 3.6 | 3.9 | 3.6 |
| PPS roughness, ts/ws (μm) | 6.26/8.17 | 6.20/5.65 | 6.15/5.52 | 6.07/5.08 | 5.90/5.12 |

TABLE-continued

| | | | | | |
|---|---|---|---|---|---|
| Bendtsen smoothness, ts/ws (ml/min) | 510/710 | 505/400 | 509/385 | 510/250 | 515/260 |
| Bendsten air permeability (ml/min) | 250 | 241 | 235 | 231 | 221 |
| Cobb-Unger oil absorption, ts/ws (g/m$^2$) | 21.0/16.5 | 20.1/14.2 | 19.5/13.6 | 19.9/14.3 | 19.4/13.1 |

| | Uncalendering | Precalendering (long nip) | | | |
|---|---|---|---|---|---|
| Nip pressure (kN/m) | base | 200 | 400 | 400 | 400 |
| Surface temperature of the thermo roll (0°) | | 200 | 200 | 290 | 290 |
| Density (kg/m$^3$) | 585 | 645 | 691 | 743 | 746 |
| Moisture content (%) | 4.2 | 3.5 | 3 | 2.5 | x |
| | 10,1 | x | x | x | 4,5 |
| PPS roughness, ts/ws (μm) | 6.26/8.17 | 5.98/5.27 | 5.82/3.70 | 5.66/2.99 | 5.44/2.66 |
| Bendtsen smoothness, ts/ws (ml/min) | 510/710 | 505/230 | 440/198 | 425/191 | 408/198 |
| Bendtsen air permeability (ml/min) | 250 | 201 | 151 | 110 | 98 |
| Cobb-Unger oil absorption, ts/ws (g/m$^2$) | 21.0/16.5 | 19.4/13.5 | 17.9/11.6 | 16.1/8.2 | 15.1/6.5 |

On the basis of the results it can be said that by means of calendering it is possible to correct even difficult cases of one-sidedness in absorption. In soft calendering conducted by means of a soft/hard roll combination, it has in tests been possible to reduce the Cobb-Unger oil absorption of the more closed side by 3.4 g/m$^2$ at the most (approx 21% from the original value), when in similar conditions it has been reduced by 1.6 g/m$^2$ on the opposite side. Correspondingly, with a long nip it has been possible to reduce the value on the more closed side even by 10 g/m$^2$ (approx 61% from the original value), whereas on the opposite side the reduction has been only 5.9 g/m$^2$.

The invention is suitable for all coatable base papers as well as paperboards, especially for pretreatment of base papers and paperboards to be coated in film transfer coating. When the invention is utilized in the treatment of grades coated in film transfer coating, it is advantageous in such cases where the surface of the web which in the film transfer coating forms the lower side, has a higher absorption level as a result of the earlier dewatering stages, which drawback can be corrected in the calendering preceding the coating.

The invention is not restricted solely to the embodiments shown in the drawings. It is also possible to use two successive precalendering nips of which the first one has higher inlet moisture content and lower calendering temperature, and the second one has lower inlet moisture and higher temperature. As a result of the high inlet moisture content, excessive drying of the web can be avoided in calendering and because the moisture is one of the variables affecting the calendering result, it is possible to use lower temperature in the first nip because of the high initial moisture content. Both nips can be long nips according to FIG. 4 in which the side whose absorption level is reduced enters in contact with the heated surface.

The invention claimed is:

1. A finishing method for a paper or paperboard web which has undergone earlier dewatering stages, comprising the steps of:

precalendering the web by passing the web from an earlier dewatering stage to a calendering stage having a calendering nip formed between a heated roll having a hot surface and a resilient backing member, wherein the web as it enters the calendering stage has a first side which has a first absorption level which engages the resilient backing member, and a second side which has a second absorption level which is higher than the first absorption level, wherein the second side engages the heated roll;

reducing the absorption level of the second side nearly to the same level or, less than or equal to the same level as the absorption level of the first side, by selecting a nip length and a nip pressure and a temperature for the heated roll;

passing the web after precalendering through a coating nip of a film transfer coating unit formed between an upper roll and a lower roll located one on top of the other so that the second side is against the lower roll and is lower than the first side; and coating the first side and the second side in the coating nip, releasing the first side from the upper roll followed by releasing the second side from the lower roll.

2. The method of claim 1 wherein the calendering step of reducing the absorption level of the second side is reduced in the precalendering step below the absorption level of the first side.

3. The method of claim 1 wherein the combined effect of the residence time of the web in the nip and the hot surface which is in contact with an outer surface of the second side of the web in the nip is utilized to produce a permanent deformation in the fibers on the said outer surface.

4. The method according to claim 3 wherein the temperature of the hot surface where it is in contact with the outer surface of the second side of the web in the nip is over 200° C.

5. The method of claim 4 wherein the temperature of the hot surface where it is in contact with the outer surface of the second side of the web in the nip is over 250° C.

6. The method of claim 1 wherein the web is guided diagonally downwards through the coating nip.

7. The method of claim 1, wherein the web is guided as a continuous web from calendering to film transfer coating in the same treatment line.

8. An assembly of a web and an apparatus for precalendering and finishing of a paper board web, comprising:

a paper web having a first side facing upwardly which has a first absorption level, and a second side facing downwardly which has a second absorption level which is higher than the first absorption level;

a calender having a first upper calendering element on a first side of a calendering nip, and a second lower calendering element on a second side of the calendering nip, the second calendering element being opposite to the first calendering element, wherein the second lower calendering element is arranged to contact the second side of the web as the web passes through the calendering nip, and wherein the second calendering element is a hot surface whose temperature is arranged higher than a temperature of the first calendering element on the opposite side of the calendering nip; and a film transfer coating unit following said calender and formed between an upper roll and a lower roll located one on top of the other, and the web extending through the coating unit so that the second side is against the lower roll and is lower than the first side;

an upper film of coating on the upper roll and a lower film of coating on the lower roll, said upper and lower films of coating contacting the upper and lower surfaces of the web respectively at a nip formed between the upper roll and the lower roll, and wherein the web extends from the nip in contact with the lower roll as the web extends away from the nip.

9. The assembly of claim 8 wherein the second calendering element hot surface has a temperature selected so that the web second side surface absorption level is below the absorption level of the first side after passing through the calender nip.

10. The assembly of claim 8 wherein the second calendering element hot surface has a temperature over 200° C.

11. The assembly of claim 8 wherein the second calendering element hot surface has a temperature over 250° C.

12. The assembly of claim 8 wherein the web extends diagonally downwards through the coating nip.

13. A method of improving the runnability of a paper or paperboard web through a film transfer coating unit, comprising the steps of:

receiving in to a precalender a paper or paperboard web which has a first upwardly facing side which has a first absorption level and a second downwardly facing side which has a second absorption level which is higher than the first absorption level;

decreasing the absorption level of the second side of the web by passing the web through a calendering nip of the precalender, formed between a heated roll having a hot surface and a resilient backing member, wherein as the web enters the precalender the web first side engages the resilient backing member, and the second side engages the heated roll;

wherein a nip length and a nip pressure of the nip and a temperature for the heated roll are selected so that the absorption level of the second side is reduced a selected amount; and passing the web after precalendering through a coating nip of a film transfer coating unit formed between an upper roll and a lower roll located one on top of the other so that the second side is against the lower roll and is lower than the first side; and coating the first side and the second side in the coating nip with substantially the same amount of coating, wherein the selected amount of absorption reduction of the second side is selected such that the absorption level of the second side allows releasing the first side from the upper roll followed by releasing the second side from the lower roll.

14. The method of claim 13 wherein the upper roll, and the lower roll, of the film transfer coating unit, are located diagonally with respect to each other at an angle of approximately 40 to 60°.

* * * * *